United States Patent [19]

Eickmann

[11] Patent Number: 4,562,770

[45] Date of Patent: Jan. 7, 1986

[54] RADIAL PISTON MOTOR OR PUMP

[76] Inventor: Karl Eickmann, 2420 Isshiki, Hayama-machi, Kanagawa-ken, Japan

[21] Appl. No.: 603,050

[22] Filed: Apr. 23, 1984

[51] Int. Cl.[4] ..... F01B 13/04; F16J 1/14

[52] U.S. Cl. ..... 91/491; 92/187

[58] Field of Search ..... 91/488, 491; 92/187

[56] References Cited

U.S. PATENT DOCUMENTS

| | | | |
|---|---|---|---|
| 1,409,757 | 3/1922 | Nelson | 92/187 |
| 2,260,240 | 10/1941 | Taylor | 92/187 |
| 4,372,179 | 2/1983 | Dolenc | 92/187 |

FOREIGN PATENT DOCUMENTS

| | | | |
|---|---|---|---|
| 1345785 | 11/1963 | France | 91/488 |

*Primary Examiner*—William L. Freeh

[57] ABSTRACT

In a radial piston pump, motor, transmission the deep diving or entering piston shoe is utilized and swingably borne in the pivot-bed of the radially reciprocating piston. Since deep diving piston shoes have large piston strokes, the shoes pivot in the pistons in large angles. Thereby a considerable force-portion of the load on the piston is transfered to the wall between the piston and the cylinder, whereby heretofore short pistons occasionally produced welding and sticking between the cylinder wall and the piston wall. The piston therefore receives radially extending portions, which may extend beyond the medial portion of the piston shoe and may even enter into the ring groove of the piston stroke actuator ring. Thereby a very long guidance of the piston on cylinder wall portions is obtained, which makes the application of effective pressure balancing pockets at correct location between piston wall and cylinder wall possible. An extended piston guide and friction-less travel of the piston in the cylinder without wearing or sticking is assured.

1 Claim, 55 Drawing Figures

Fig. 1-B
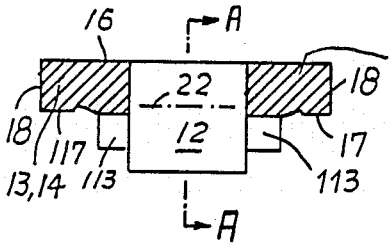
Fig. 1-A
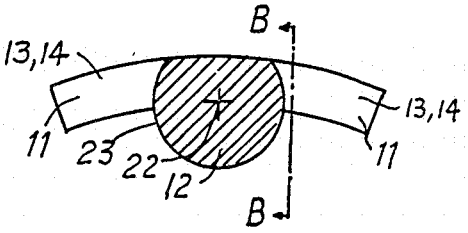
Fig. 1-C
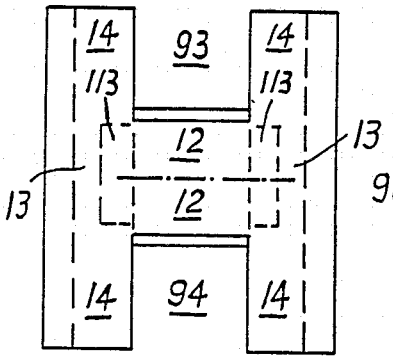
Fig. 2
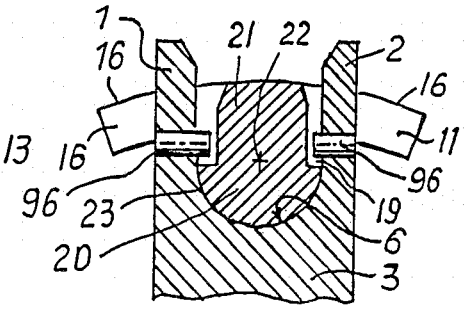
Fig. 3
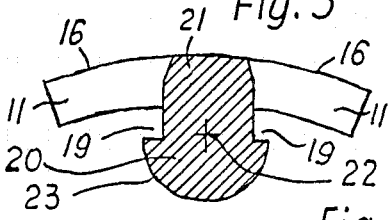
Fig. 5
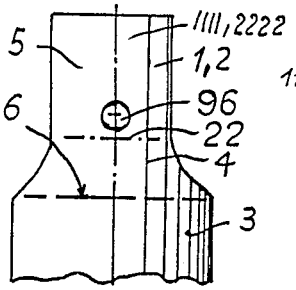
Fig. 4
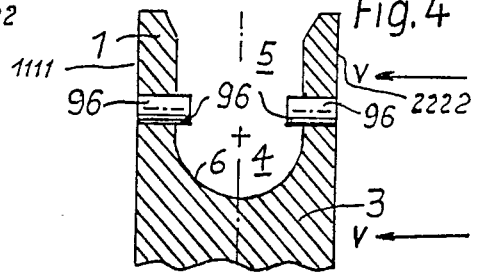
Fig. 7-B
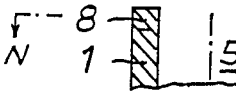
Fig. 7-A
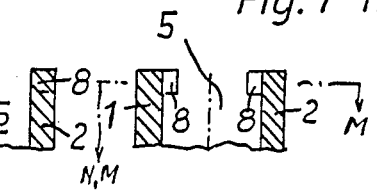
Fig. 6
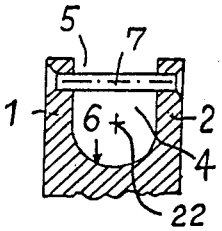
Fig. 7-D
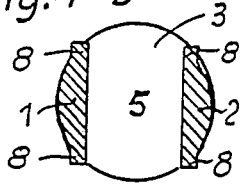
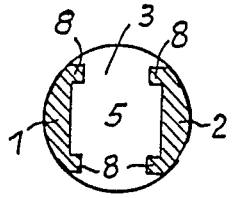
Fig. 7-C 31
1026
30
1026
12
32
34
35

ACTUATOR
GROOVE
124
29
27
28
53
α
25
ROTOR
1
12
PISTON
C
26
16
e
2
14
24
43
4,6,23
11,12
34
35

1026
1026
1111
2222
35
34
1
21
16
22
20
2
29

124
124
34
35
124
28
1026
27
1111
20
63
21
25
C
shoe
shoe
16
5
22
e
2
1026
2222
24
26
63
29
27
34
28
35
4,6,23
20
124

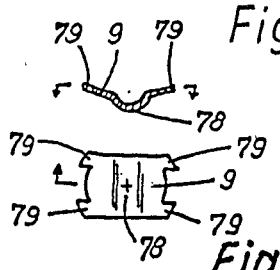
Fig. 13
Fig. 17
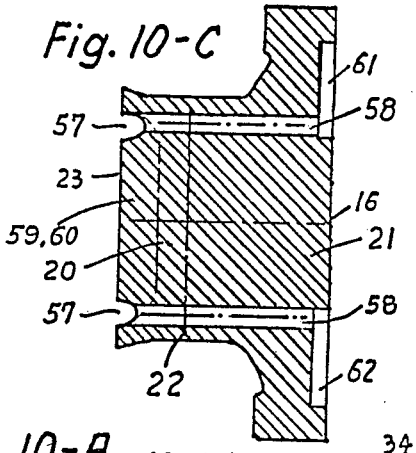
Fig. 10-C
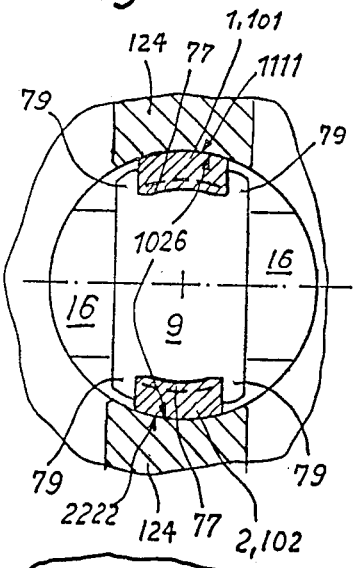
Fig. 10-B
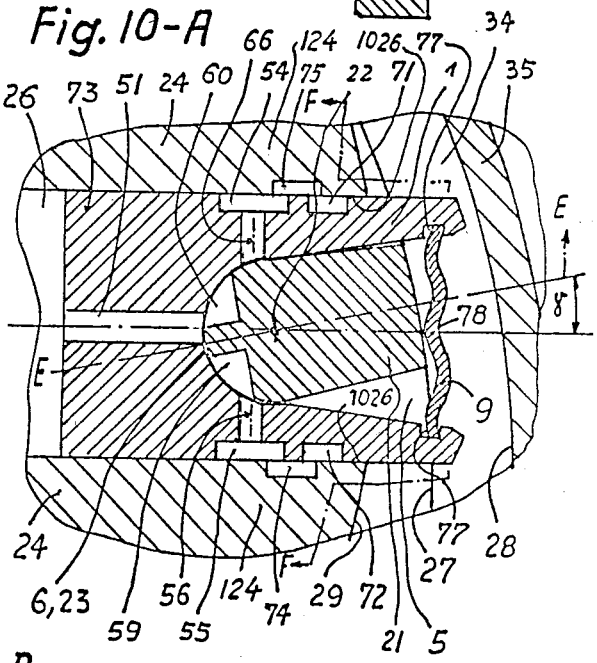
Fig. 10-A
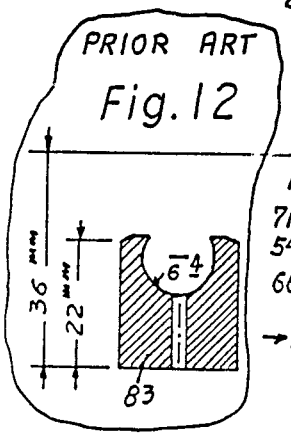
PRIOR ART
Fig. 12
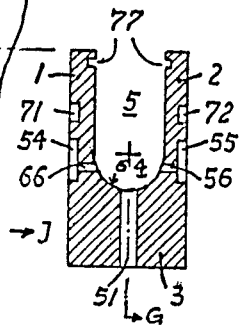
Fig. 11-B
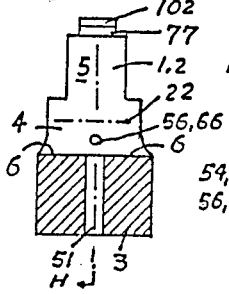
Fig. 11-A
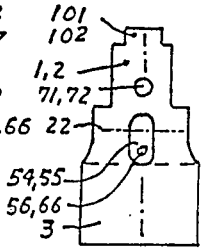
Fig. 11-C Fig. 14-B
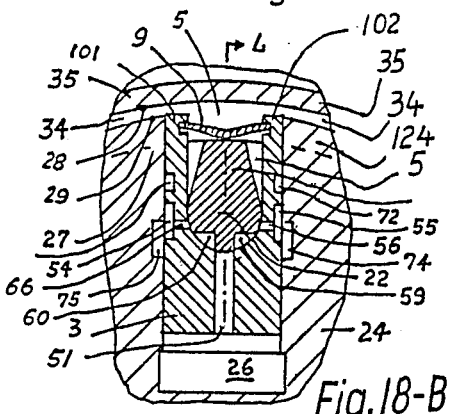
Fig. 14-A
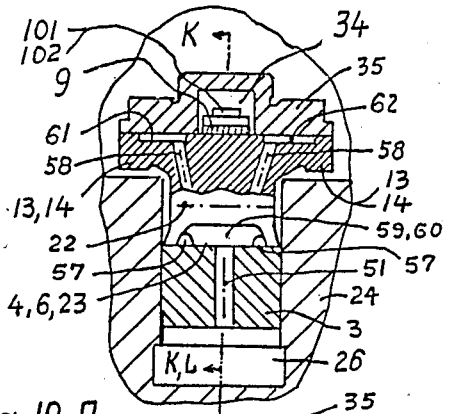
Fig. 18-B
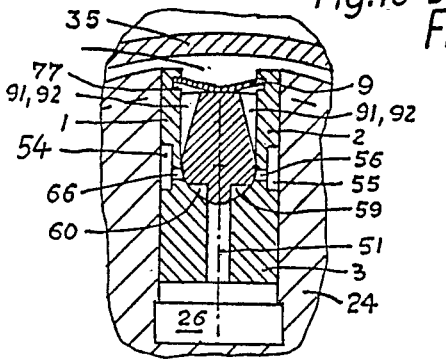
Fig. 18-A
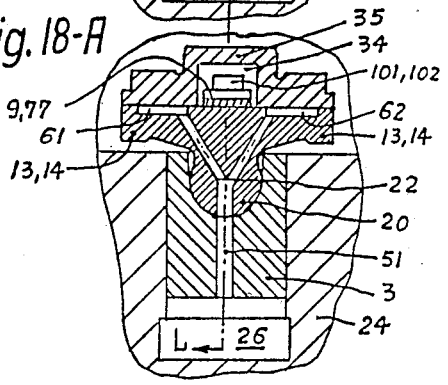
Fig. 15-B
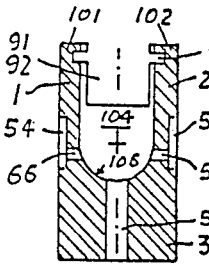
Fig. 15-A
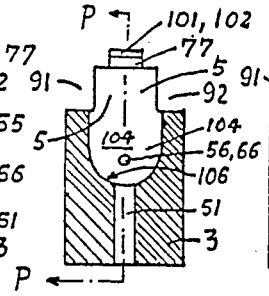
Fig. 15-C
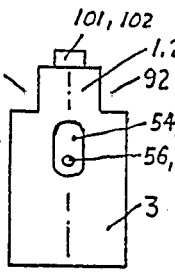
Fig. 16-B
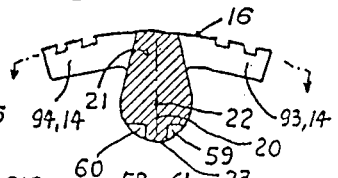
Fig. 15-D
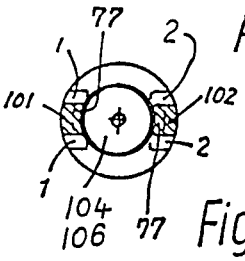
Fig. 16-A
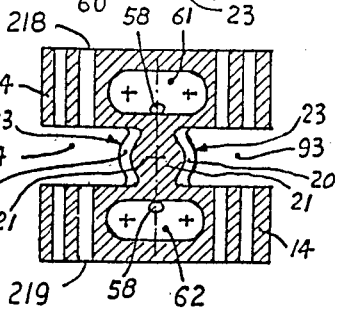
Fig. 19-B
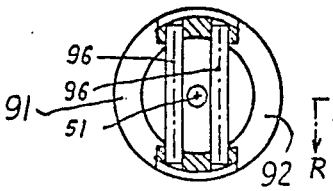
Fig. 19-A
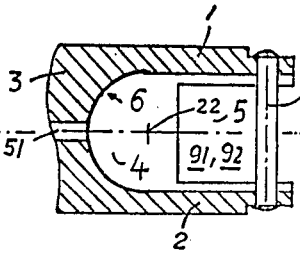
Fig. 19-C
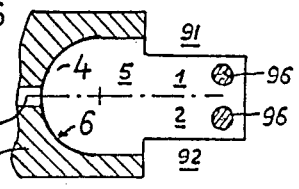

Fig. 20

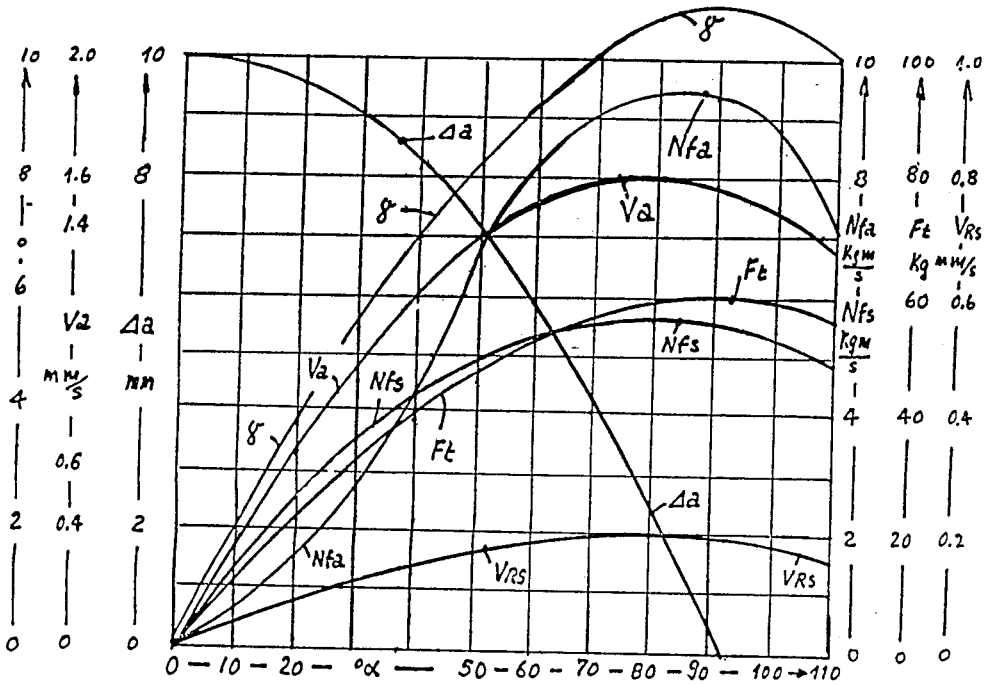

α = Rotary angle of piston axis from outer dead point = zero.

γ = Angle of pivotion of piston shoe in piston.

Δa = Radial inward movement of piston.

Va = Radial inward velocity of piston.

Ft = Tangential = lateral force of piston wall onto cylinder wall

VRS = Pivot-velocity = relative velocity between faces 6 and 23.

Nfa = Friction loss at travel of piston along cylinder wall when no tangential balancing pockets 71,72,54,55 are applied and when friction factor of mostly dry friction is $\mu p$ = o,20.

Nfs = Friction loss at pivotal movement between faces 6 and 23 of piston and pivot-portion of shoe, when half-dry friction factor if $\mu s$ = o,10 because no or too unsufficient balancing pockets 59,60 are applied.

Above values are valid for :
100 Kg/cm$^2$ pressure; 1500 upm; piston diameter = 20 mm and inner diameter of actuator ring is da = 130 mm; piston stroke is 20 mm at 180 degrees rotation alpha; according to Rotary Engine Kenkyusho Report RER-7906 .

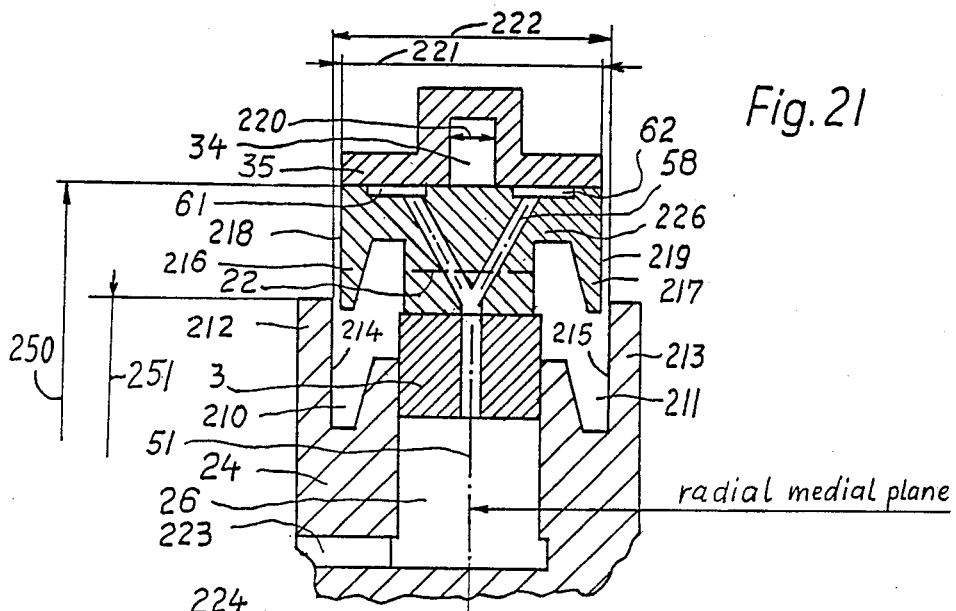
Fig. 21
Fig. 22
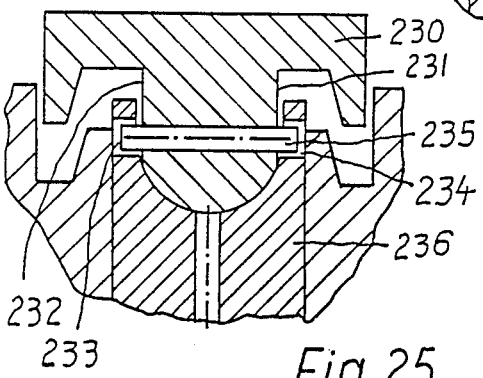
Fig. 23
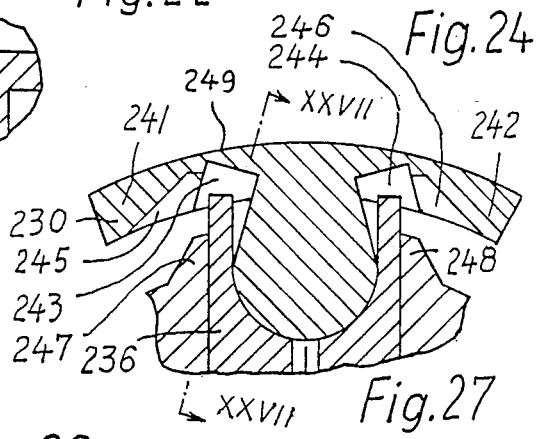
Fig. 24
Fig. 27
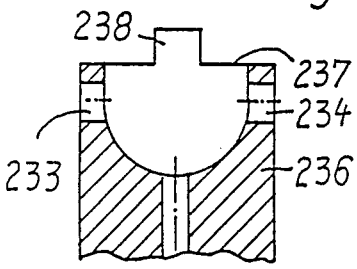
Fig. 25
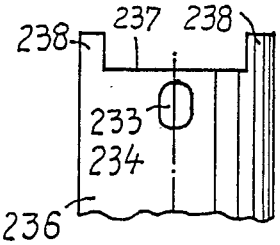
Fig. 26
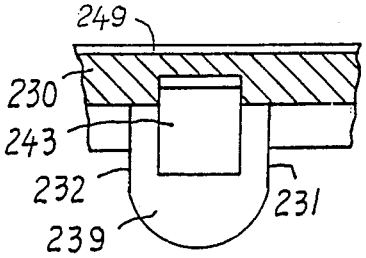
Fig. 27

RADIAL PISTON MOTOR OR PUMP

BACKGROUND OF THE INVENTION

Radial piston devices have outer piston shoes which do not enter into the cylinder. That is the common design of the past and present. In my U.S. Pat. No. 3,223,046 the entering piston shoe was introduced, which elongated the piston stroke and thereby increased the power of the device of equal outer diameter and weight. It did so by partially entering the piston shoe into the respective cylinder through the form of an "H" of the piston shoe's outer portion.

My U.S. Pat. No. 3,277,834 thereafter introduced the "deep-diving" piston shoe. The deep diving of the piston shoe further extended the stroke of the piston of a device of a given diameter and weight and thereby drastically increased its power still further. This success was reached thereby, that the piston stroke actuator ring obtained an inner annular groove for the reception of the outer portions of segments of the rotor. The "H-formed" deep diving piston could thereby full enter into the respective cylinder beyond the outer diameter of the outer rotor portions. The increase in power of the devices of a given diameter and weight increased so drastically thereby, that the power of a device of given dimension and weight multiplied many times.

Over the years of intensive research these devices with deep diving piston shoes were improved to deliver more and more power per unit of size. Especially they were also developed as motors. Motors can succeed only with the very large piston strokes compared to the inner diameter of the actuator ring, which is called "da". The relation of stroke "s" to "da"; namely the relation S/da defines basically the power and quality of such a device.

With the ever increasing power and strokes the guide-length of the piston did however not increase enough. That led, as is now discovered, thereto, that the piston's outer end is pressed stronger against the wall of the cylinder, than the inner end of the piston, because of the location of the swing point or swing axis of the pivotal assembly of the piston and piston-shoe in the neighborhood of the outer end of the piston.

Since the piston shoes pivot in the pivot beds of the pistons, the hereafter used terms "pivotion" and "pivotation" define the pivotal movements of the pivotal portions or pivot portions of the piston shoes in the bearing beds of the respective pistons.

THE AIMS AND OBJECTS OF THIS INVENTION

By this invention it is recognized, that the deep diving piston-shoe assembly forces the outer portion of the piston under tangential force-portions of the load by the pivoting action of the shoe in the piston stronger against the wall of the respective cylinder, than the inner portion of the piston.

That is so, because the swing- or pivot-center is located relatively outward, radially outward in the respective piston. When it would be transferred radially more inward into the piston, the angle of pivotation would still become bigger and the piston shoe portions outward of the pivot-center would become longer, whereby the medial outer portion of the piston shoe would become too thin and the tangential force portion under the bigger angle of pivotation would become too great for best operational results.

It is therefore the aim of the invention to prevent locally stronger pressing between the wall of the cylinder and the wall of the piston than appears at other locations.

The next aim of the invention is, to lay the swing- or pivote center as far as possible into the middle of the guide portion of the piston on the cylinder wall.

Another aim of the invention is, to provide space for effective fluid pressure pockets between piston walls and cylinder-walls at the correct location;

and a still further aim of the invention is, to provide a still longer piston guide on the respective cylinder wall portion.

To reach these aims, the invention provides the following solutions or objects, whereby it is further attempted and assured, that these means, objects and solutions are able to to be made with best and, as far as possible, less expensive, manufacturing methods.

(a) The piston obtains radial extensions, which at least partially embrace the medial portion or the pivot-portion of the piston shoe.

Thereby the piston guide is radially extended, because the respective piston portion, namely the extension, provides the longer guide on the respective portion of the wall of the cylinder.

(b) To fasten the piston shoe pivot-portion on the extensions of the pistons.

Thereby the heretofore expensive partial embracement of the pivot portion of the piston shoe radial outwards of the pivot-center is prevented and spared. The piston shoe can now become pressed or casted and can be machined with radii extending over surfaces of less than 180 degrees or maximally 180 degrees. That eases the machining procedures very effectively and reduces the costs of the piston shoes to a fraction of the former piston shoes.

(c) The radially extended portions of the piston may be extended beyond the outer face of the piston shoe, so, that at certain locations of revolution of the rotor they enter into the annular inner ring groove of the piston stroke actuator ring.

Thereby the maximum of possible length of radial guidance of the piston in the cylinder is obtained.

Further obtained thereby is, that the outer portion of the piston becomes practically substantially as long as the inner portion of the piston shoe is. The lateral force portion or tangential force portion of the load on the piston, which appears, when the piston shoe pivotes out of the neutral position is then acting almost exactly in the middle of the piston. Best load division is thereby obtained, welding between piston and shoe is reduced and a location is provided, where fluid pressure balancing pockets can be set at a best effective place, namely in the middle of the radial length of the piston. and;

(d) The piston-shoe may be fastened or retained in the piston by simple retaining means, provided radially outward of the piston shoe in the piston-extensions, whereby they become located within the annular ring groove of the piston stroke actuator ring.

Thereby the expensive fastening of the pivotable piston shoes in the pistons of the past is spared and the costs of the piston shoes are drastically reduced. The manufacturing times are shortened.

The invention, thus, provides a radial piston device with a better and longer piston guide and more effective movement of the piston in the cylinder with less friction between the walls of the pistons and the cylinders. It thereby increases the power of a device of a given dimension and weight. It further reduces the costs of manufacturing of the piston shoes and it makes the device more reliable over an extended life time by the longer and better guide of the piston portion on the respective cylinder wall portions. It obtains all these features without increasing the weight to size of the device.

BRIEF DESCRIPTION OF THE DRAWING

FIG. 1-A shows a cross-sectional view through the middle of an embodiment of a piston shoe of the invention.

FIG. 1-B is a sectional view through FIG. 1-A along the arrow B—B of FIG. 1-A.

FIG. 1-C is a view from top onto the piston shoe of FIG. 1-B.

FIG. 2 is a longitudinal sectional view through an embodiment of an assembly of a piston with the piston shoe of the invention therein.

FIG. 3 is a cross-sectional view through the piston shoe of FIG. 2, and the piston shoe is separately demonstrated in this FIG. 3.

FIG. 4 is the longitudinal sectional view through the piston of FIG. 2 and the piston is seperately shown in this FIG. 4.

FIG. 5 shows a view onto the piston of FIG. 4 seen along the arrow V—V of FIG. 4.

FIG. 6 demonstrates in a longitudinal sectional view through a portion of a piston another fastening method to secure the holding of the shoe.

FIG. 7-A is a longitudinal sectional view through portions of a piston.

FIG. 7-B shows the portions of FIG. 7-A in a preparing stage.

FIG. 7-C is a cross-sectional view through FIG. 7-A along the arrow M—M.

FIG. 7-D is a cross-sectional view through FIG. 7-B along the arrow N—N.

FIG. 10-A is a cross-sectional view through a most advanced portion of a pump or motor with a piston and piston shoe assembly of the invention therein.

FIG. 10-B is a sectional view through FIG. 10-A along the arrow F—F.

FIG. 10-C is a sectional view through the piston shoe of FIG. 10-A along the arrow E—E of FIG. 10-A.

FIG. 11-A is a longitudinal sectional view through a piston of the invention.

FIG. 11-B is a sectional view through FIG. 11-A along the arrow H.

FIG. 11-C is a view onto the piston of FIG. 11-A seen from arrow J of FIG. 11-B.

FIG. 12 is a sectional view through a piston of the prior art for comparison.

FIG. 13 shows a retaining means in a cross-sectional view.

FIG. 17 shows the retaining means of FIG. 13 seen from above.

FIG. 14-A is a longitudinal sectional view through a radial piston device with a piston and a piston shoe of the invention assembled therein.

FIG. 14-B is a sectional view through FIG. 14-A along the arrow: K.

FIG. 15-A demonstrates a longitudinal sectional view through another piston of the invention.

FIG. 15-B is a sectional longitudinal view through FIG. 15-A along arrow: P—P.

FIG. 15-C is a view from arrow Q onto the piston of FIG. 15-B.

FIG. 15-D is a cross-sectional view through extensions 1 and 2 along the section line T of FIG. 15-B seen downwards in FIG. 15-B.

FIG. 16-B is a cross-sectional view through another piston shoe of the invention.

FIG. 16-A is a sectional view through FIG. 16-B along the arrow: Z—Z.

FIG. 18-A is a longitudinal sectional view through a portion of a radial piston device with the piston of FIG. 15-A and the piston shoe of FIG. 16-A assembled therein.

FIG. 18-B is a sectional view through the medial line of FIG. 18-A, along arrow: 4, whereby the piston of FIG. 15-B and the piston shoe of FIG. 16-B is seen therein.

FIG. 19-A is a longitudinal sectional view through another piston of the invention.

FIG. 19-B is a cross-sectional view along the arrow: S—S through FIG. 19-A, namely through the radial outer portion thereof along the axes of pins 96, wherein however the pins 96 are shown in a view onto them.

FIG. 19-C is a cross-sectional view along the arrow: R—R through FIG. 19-A along the longitudinal center line thereof, whereby the view also crosses the pins 96 therein.

FIG. 20 demonstrates a schematic of strokes, inclinations, forces and the like in an actual device of the invention.

FIG. 21 is a longitudinal sectional view through an embodiment of the invention.

FIG. 22 shows a portion of FIG. 21.

FIG. 23 is a longitudinal sectional view through a portion of another embodiment of the invention.

FIG. 24 is a cross-sectional view through FIG. 23 along the line Q—Q therein.

FIG. 25 is a longitudinal sectional view through a portion of a piston.

FIG. 26 shows the piston of FIG. 25 seen from the left of FIG. 25.

FIG. 27 is a cross-sectional view through FIG. 24 along the line XXVII—XXVII.

FIG. 31 shows the shoe of FIG. 29 seen from the axial end thereof.

DESCRIPTION OF THE PREFERRED EMBODIMENTS

Figure 8:
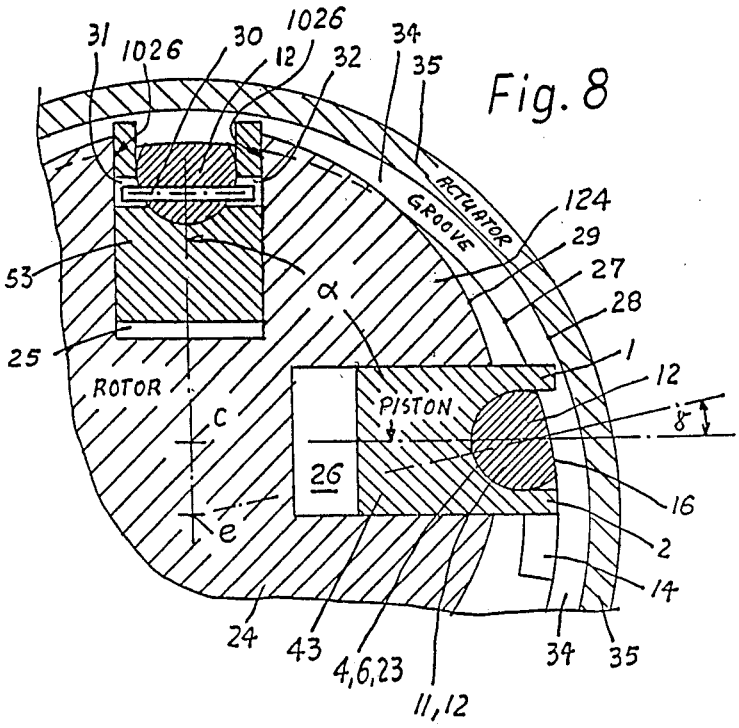
FIG. 8 shows the piston shoe of FIG. 1 as shown in FIG. 1-A, assembled in a portion of a radial piston motor and is a cross-sectional view through a portion of such motor.

In FIG. 1 the piston shoe 11, which is one of the embodiments of the invention, is shown. The right FIG. 1-A is a cross-section through the left FIG. 1-B along the line A—A and the right FIG. 1-A is a cross-section along line B—B through the right FIG. 1-B of FIG. 4. FIG. 1-C shows FIG. 1B seen from above.

FIG. 2 is a sectional view through an assembly of a piston and shoe; namely the shoe of FIG. 3 and the piston of FIG. 4.

The piston shoe 11 has a medial portion 12. This is a part of a cylinder and can therefore be machined on a lathe machine or on a round grinding machine, which was not possible for the medial portions of my former patents. Thus, the medial portion of the piston shoe is simplified by this embodiment of the invention and it can now be easily machined.

The medial portion 12 is integral with the end-portions 13, which extend into the guide portions 14, whereby the entering or deep-diving piston shoe has the mentioned "H"-Form in the view upon it in FIG. 2. The term "H-formed piston shoe" has become standard terminology at the West German Patent Office for the entering and deep diving piston shoes of the inventor.

The axial end-portions 13 and the guide portions 14 do not principally differ from my beforementioned earlier patents of the entering or deep-diving piston shoes.

However, for the radial stabilization of the piston shoe it is preferred to provide support portions 113 endwards of the medial portion 12 at least in a suitable axial extent.

The piston shoe further has the outer face 16 and the inner guide faces or the end-guide faces 17 and 18 may be provided, if so desired. The faces 16 to 18 are also known from my mentioned earlier patents and do not differ principally from the piston shoes therein. Portions 13 may have radial support portions 113. Thereby portions 113 extend axially from medial portion 12 to act as radial supports.

The piston shoe, shown in the sectional FIG. 3 is equal to that of FIG. 1 with the only one difference, that outcuts or depressions 19 are provided radially of the pivotal center 22.

The reason for the provision of depressions 19 will become understood from the following description of FIG. 4.

FIG. 4 shows the piston 3 with its novel radial extension 1 and 2. It has the bearing bed 4 for the pivotable reception and bearing of the medial portion 12 of the piston shoe, for example of FIGS. 1, 2. Shoe 11 swings or pivots in bed 4 around pivot center 22.

Extensions 1 and 2, which may also be called "fingers" or "arms", form outer faces portions 1111 and 2222 respectively in the direction(s) of the outer diameters of the pistons 3 and they are guided on and sliding at least partially along the respective wall portions 1026 of the cylinders or of the radial extensions (segments) thereof, after they have been assembled into the respective cylinders. The wall portions 1026 extend also along the segments or radial extensions 124 of the rotor 24 of my mentioned patents. See hereto for example, FIGS. 8 to 10, which show the wall portions 1026. The rotor 24 and the extensions (segments) 124 are known from my U.S. Pat. Nos. 3,223,046 or 3,277,834. As far as the wall portions 1026 are located on the extensions 124, they are extending in the directions of the faces of the respective wall portions of the cylinders 26 radially outwardly thereof.

The extensions 1,2 which are also visible in FIG. 5, are novel portions of the invention.

A further novel matter of the invention is, that the retainer members 96 may be applied in the extensions 1 and 2, after the assembly of piston shoe 11 into piston 3. These retainers 96 will then enter into the depressions 19 of piston shoe 11, whereby they retain the piston shoe within the piston, allow the piston shoe to pivot in the piston, but retain the piston shoe from escaping out of the piston.

The piston shoes medial portion 12 of the piston shoe of FIG. 3 has therefore a bottom portion 20 of wider extension and an upper portion 21 of smaller lateral extension. The depressions 19 are formed on the upper portion and may end about in a radial height equal or close to the medial pivotal center 22.

The piston shoes of FIGS. 1 to 3 can now be forged, cast or pressed, because any embracement over more than 180 degrees as in my former patents, is spared and faces with equal radii of less than 180 degrees around a center can be cast, pressed, forged or machined even with surface grinding machines and formed grinding wheels. The piston shoes of the new system are therefore very inexpensive and can be easily and quickly produced.

The described retaining assembly does not necessarily force the inner face 23 of the respective piston shoe for close engagement on the surface of the bearing bed 4. But it can be forced to such engagement by addition of respective other retaining means of others of the Figures. However, such forced engagement of faces 23 on the bed 4 is not at all times required, because at the pressure strokes in the device the pistons force themselves against the faces 23 of medial portions 12, whereby the faces 23 closely seal and bear in beds 4 of pistons 3. This mentioned "force themselves" is obtained by the pressure below the bottom of the respective piston in the respective cylinder at the high-pressure stroke of the respective piston 3.

The referentials 1 to 23 are basic referential numbers, which cite parts or portions, which will repeat in many of the later Figures. They will get a pre digit in other Figures or may appear in other Figures without a further pre digit. But in the description of the other Figures, the pre-digit will be left out. That means, that regarding referential numbers 1 to 23 only the one or two end digits will be mentioned in the description of the other Figures. Because thereby it will be easier visible and understandable, that the respective parts, portions, or faces, centers and like of the other Figures have basically equal functions as in FIGS. 1 to 5.

FIG. 2 demonstrates the assembly of the piston shoe of FIG. 3 into the piston of FIG. 4. Thereby the entering of retaining members 96 into the depressions 19 becomes visible.

In FIG. 6 another retaining means for the holding of the piston shoe in the bed in the piston is demonstrated. In this Figure a pin means 7 is inserted into piston 33 at a radial height slightly above the outer face 16 of the respective piston shoe 11. Pin means 7 extends from piston extension portion 1 through the open gap 5 radially above the pivot bed 4 into or through piston extension portion 2. Thereby the retaining of the piston shoe in the pivot bed 4 of the piston with end digit 3 is assured.

As seen from FIG. 4, the piston's pivot-bed 4 has a bearing bed surface 6 of a configuration of a face with equal radius around a common center 22. Such center may be a center line or a center point 22. The bearing face 6 of equal radius around center 22 may be a part cylindrical face with equal radius around a center line 22 or it is a part ball formed face with an equal radius around a center point 22.

In FIG. 7 a still other retaining means for the holding of the piston shoe 11 in a respective piston 3 is demonstrated. The upper left portion 7-B of FIG. 7 shows the forming of the piston extensions 1,2 before the insertion of the piston shoe. The retainer portions 8 are formed to extend laterally of the narrowed opening gap 5. The piston shoe 11 is then inserted through opening gap 5 into the pivot-bed 4. Thereafter the retainer portions 8 are bent around about 90 degrees, so, that retainers 8 of portion 1 show towards retaines 8 of portion 2 and vice-versa, whereby the retainers 8 extend into gap 5, whereby they close gap 5 partially. This is seen in the right portion 7-A and in the right bottom portion 7-C of FIG. 7. The right portions 7-A and 7-C of FIG. 7 thereby show the configurations of retainers 8 after the assembly of the piston 11 into the piston bed 4. Gap 5 is then partially closed and piston shoe 11 is effectively retained within gap 5 and pivot-bed 4.

In FIG. 8 the rotor 24 contains cylinders 25 and 26 in that portion of the rotor, which is shown in the Figure. Piston 43 reciprocates in cylinder 26 and piston 53 reciprocates in cylinder 25. In piston 43 the piston shoe 11 of FIG. 1 is pivotably borne in bed 4 without mechanically provided retaining means. It is kept in bed 4 simply by the pressure of fluid in cylinder 26. Such pressure forces the piston 43 outwards, whereby the face 6 of bed 4 automatically engages the pivot face 23 of medial portion 20 of the piston shoe 11.

Referential 27 shows the piston stroke actuator guide face. 29 is the outer diameter of the rotor segments 124 of rotor 24. The annular ring groove 34 of the piston stroke actuator ring extends from inner faces 27 to the outer face 28 of the groove in piston stroke actuator 35. It is seen in this portion of the Figure, that the extensions 1 and 2 of piston 43 extend in operation of the device radially beyond the outer face 16 of piston shoe 11 into the said annular ring groove 34 of the actuator 35.

Piston 53 shows another embodiment of a retaining means for holding piston shoe 11 in the bed 4 of the piston 53. In this embodiment a pin 30 is inserted through the inner portion 20 of the medial portion 12 or through the medial portion 12 of the piston shoe 11. The said retaining pin 30 extends beyond the medial portion 12 into recesses 31 and 32 in the extension portions 1 and 2 of piston 53. The recesses 31 and 32 are slightly wider in cross-sectional area, than the respective cross-sectional area of the pin means 30 is, in order to permit the pivotal movement of the piston shoe within the piston bed 4. The cross-sectional area of recesses or slots 31,32 is however so located, dimensioned and resticted, that the pin ends of pin 30 can not move too much radially outward. Thereby the piston shoe 11 is also by this retaining means of the invention effectively contained within gap 5 and bed 4 in piston 53.

The embodiment of FIG. 8 is especially convenient for application as a motor. Because the lateral or tangential component of forces than acts at a great radial distance from the center of the rotor against the cylinder walls. That gives relatively slight forces onto the cylinder walls, but provides a great torque.

Figure 9:
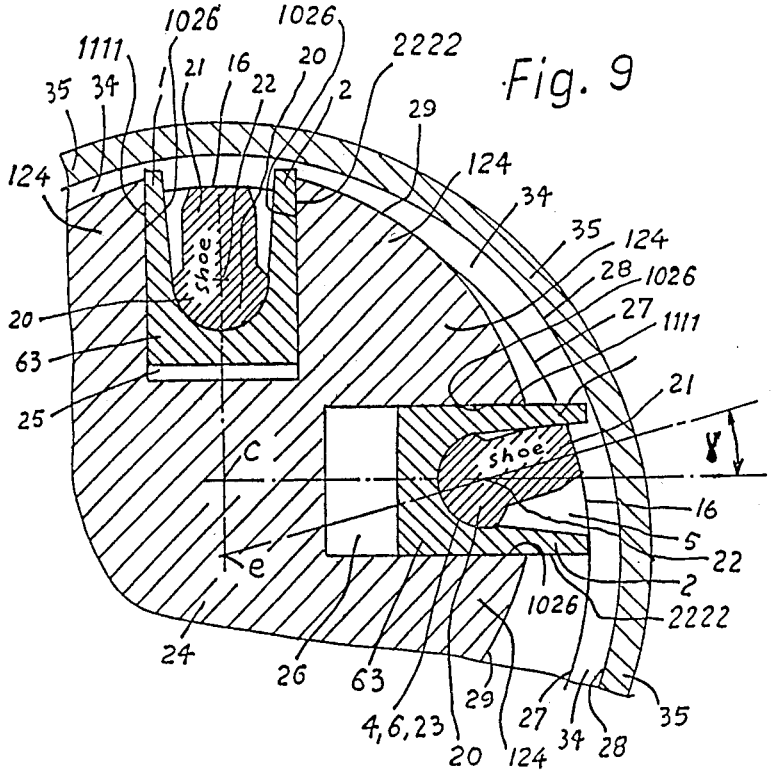
FIG. 9 shows for comparison such assembly of a piston shoe in a pump for comparison with the motor and is a cross-sectional view through a portion of such pump.

The embodiment of FIG. 9 may also be used as a motor, but it is also suitable to be used as a pump. The difference compared to FIG. 8 is, that the pivot-center 22 in FIG. 9 is located deeper in the piston than in FIG. 8. The pivotal centers 22 of pistons 63 of FIG. 9 are thereby closer to the center axis of rotor 24 than in FIG. 8 and consequently the arms of the action of torque are shorter. The tangential forces onto the cylinder walls are therefore higher than in the embodiment of FIG. 8.

An analysis of pumps and motors will show, that both are equal devices, acting just in the reversed way. It would therefore appear on first glimpse, that the same devices of equal parts and dimensions can be used as pumps as well as also as motors. And, this assumption is in fact true.

When however, the highest quality of a device is desired, such assumption on first glimpse is not absolutely true any more. Because in a pump the piston moves radially inwardly as its pressure stroke or power stroke. But in a motor the piston moves radially outwardly at the pressure and power stroke. In those devices, where the swing or pivotal-center 22 is in the middle of the acting guide face length of the piston on the cylinder wall, the actual actions between the piston wall and the cylinder wall are equal in pumps and motors. But, when the pivot-center 22 is not in the middle of the guide face length of the piston, the matter becomes different.

When in a pump, the pivot-center is too much inwards of the piston, the lateral forces will too strongly press the inner corners of the pistons against the cylinder walls and wear and weld there. When in a motor the pivot-center is too much radially outward in the piston, the outer corners of the pistons will be pressed under the lateral forces too strongly against the cylinder wall portion and they will wear there and finally weld there.

It is this basic consideration, which discovers, that in the devices of the former deep diving piston shoes, the guide faces of the pistons were too short radially outward of the pivot-center 22 of the pistons, whereby the described wearing and welding of the outer corners of the pistons could occur in motors.

Consequently, the gist of the invention is, to elongate the guide face ofthe piston on the cylinder wall portion drastically radially outward of the pivot-center 22. The invention does so by providing the piston extensions 1 and 2 and by extending them radially outwardly beyond the pivot-center 22 and in the embodiments of the FIG. 8 also into the annular ring groove 34 radially beyond the outer face 16 of the piston shoe 11.

In FIG. 9 the extensions 1 and 2 may also be an integral extension 1, surrounding a ball part formed portion 20 of the piston shoe. Portion 1 or portions 1 and 2 extend in such case, (not shown in Figures), only radially outwards beyond the pivot-center 22 but not into the annular groove 34 and not beyond the outer face 16 of the piston shoe. The consequence thereof is, that the device of FIG. 9 is applicable to highest pressures and speeds only in a pump. In motors its application is restricted to slightly higher than medial pressure in fluid, for example about 4000 psi. The simplicity of manufacturing and the possibility to operate without a retaining means however leads to use of this device also as motor as far as the said medial pressure in the motor is satisfactory.

FIG. 10 demonstrates in three sectional views 10A to 10C, respectively, an embodiment of the invention for application in the highest advanced technology motor. It may also be used in a pump. Cylinder 26 contains the therein reciprocating piston 73. The piston extension portions 1 and 2 extend beyond the pivot-center 22 and beyond the piston shoe's outer face 16 into the annular ring groove 34 of piston stroke actuator 35. This embodiment has a novel retaining means 9 in the form of a spring-plate inserted into groove portions 77 provided in extensions 1 and 2. Spring plate 9 may have a medially inwardly directed portion 78 to press flexibly against the outer face 16 of the piston shoe to maintain close contact between faces 6,23. Spring plate 9 may also have extensions 79, visible in the left portion of the Figure, in order to embrace narrower outer extensions 101 and 102 of extensions 1 and 2 in order to prevent rotation of the spring plate 9 relatively to the piston and the piston shoe.

Another feature of the invention of this embodiment is, that, when the extensions 1 and 2 extend into the ring groove 34, they are prevented from rotation. That means, that the piston can not rotate around its axis. The same effect is also already obtained, when the extensions 1 and 2 extend beyond the pivot-center 22. Because then, since the piston shoe can not rotate, the entrance of the extensions 1 and 2 into the recesses of the "H" of the "H-formed" piston shoe prevents rotation of the piston relatively to the piston shoe and thereby also prevents rotation of the piston around its axis.

The described prevention of rotation of the piston 3 around its longitudinal axis makes it possible to accurately provide fluid pressure balancing pockets between the piston wall and the respective portion of the cylinder wall. These fluid pressure pockets take over the major portion(s) of the lateral, tangential, load which is exerted by the pivotal movement of the piston shoe over the piston onto the cylinder wall.

The Figure shows, that these fluidpressure pockets, which are recesses filled with pressure fluid, are located in the Figure exactly in the middle of the radial guide of the piston.

Pressure in fluid enters through piston passage 51 into recesses 59 or 60 respectively, depending on the pivot-direction of the piston shoe. Recesses 59 and 60 are also radial fluid pressure balancing recesses which take over a large portion of the radial forces between piston 73 and shoe portion 20. They are communicated by the outer recesses 57, visible in the upper portion of the Figure. When recess 59 or 60 communicates with passage 56 or 66, the fluid and its pressure is led either into tangential balancing fluid pressure pocket 54 or 55. These pressures either in fluid in recess 54 or 55 provide forces which are about equal, but oppositionally directed, relative to the force exerted by the lateral component of fluid pressure forces under the pivot-angle of the piston shoe onto the piston. The communication between passages 56 or 66 and pockets 54 or 55 starts, according to design, about at 40 to 50 degrees rotary angle alpha of the rotor. One of the pockets 54 or 55 becomes loaded with high pressure and the other is excluded from high pressure supply. That is required to direct the force of fluid into that portion of the piston which is pressed toward the respective cylinder wall by the respective angle of inclination of the piston shoe at its pivotation.

The piston 73 may also be provided with secondary balancing recesses or fluid pressure pockets 71 and/or 72. When they are provided, then communication passages 74 and 75 are precisely set into the respective walls of the cylinders. The function of such provision is, that, when the rotary angle alpha of the rotor increases to about 75 to 105 degrees, the lateral thrust component of the forces on the piston increases further, because the inclination angle "gamma" of the pivoting shoe increases steeper.

The schematic FIG. 20 shows the results of calculation of the strokes, inclinations, etc. of a sample of a radial piston device. Therefrom it is seen, that the lateral forces of the piston increase towards about 45 degrees to become extensive there and that they increase further towards about alpha ninety degrees to become a maximum there.

The communication passages 74 and 75 are now provided at a radial distance from the center axis of the rotor, that they start to communicate recess 54 with secondary recess 71 or recess 55 with secondary recess 72 at rotary angles "alpha" from about 75 or 85 to about 95 or 105 degrees. Thereby the first recesses 54, or 55, in combination with the secondary recesses 71 or 72 take over the peak of the lateral forces of the piston at the peak occurrance around the 90 degrees rotary angle "alpha".

At other rotary angles "alpha" the communication to the secondary recesses 71 or 72 does not exist, so, that at other rotary angles alpha the recesses 71 and 72 are not loaded with high pressure fluid and, therefore, do not or do not fully act. Instead of providing first and secondary fluid pressure balancing recess pairs 54,55 and 72,71 it is also possible to set pluralities of higher number of such tangential balancing recesses and a respective plurality of communication passage pairs 74,75. As more such steps are set as closer the take over of lateral forces nears the stepless and perfect take over the lateral, tangential forces of the pistons. Costs of producing the recesses and communication passages, however, leads in practical application to only one or two recess pairs, when no complete stepless or almost stepless take over of lateral forces by fluid pressure pockets is required.

The top portion 10-C the Figure is a cross-sectional view through the bottom right FIG. 10-A along line E—E. It shows the respective configuration of the piston shoe in the presently most advanced form, containing also the passages 58 which lead the pressure fluid into the balancing pockets 61 and 62 in the outer face 16 of the piston shoe to prevent wearing between the actuator ring inner face(s) 27 and outer face 16 of the piston shoe.

The bottom left portion 10-B of FIG. 10 is a cross-sectional view through the bottom right portion 10-A along the arrowed line F—F in order to see clearly the configuration of spring retainer 9, the narrowed portions 101 and 102 of extensions 1 and 2, to see the extensions 79 which embrace portions 101 and 102 in order to prevent rotation of retainer 9 and in order to see, that the top-piston assembly remains axially seen within the axial extension of the rotor extension segments 124, which form wall portions, whereby they remain narrow enough to remain within annular groove 34.

FIG. 11 shows in three views 11-A to 11-C the piston 73 of FIG. 10 in a separate demonstration to show the members described at hand of FIG. 10 more clearly.

The Figure is shown in a 1:1 scale for a 42 cc motor. Medial portion 11-A is a section along line G—G of the left portion 11-B. The left portion 11-B is a sectional view along line H—H of the medial portion 11-A and the right Figure 11-C is a view onto the left portion 11-B along the view from J—J.

FIG. 13 shows an example of the spring plate or retainer means 9 in a separated view. FIG. 13 is a section through it and FIG. 17 shows a view from top onto it.

FIG. 12 is a longitudinal sectional view through a piston 3 of my former art technology. It is again drawn in a 1:1 scale for a 42 cc motor for comparison with the novel piston of the invention. The guide length of the piston of FIG. 12 of my former technology is 22 mm compared to a guide length of 36 mm for my novel piston of FIG. 11. That gives an elongation of the piston guide of 36:22=1.65 times elongation of the guide length of the novel piston of the invention compared to the piston of the former art.

In FIG. 14 the piston and shoe of FIGS. 10 and 11 is assembled into a radial piston device for 42 cc/revolution in a one to one scale. The right portion 14-A of the Figure is a section along line L—L of the left portion 14-B and the left portion 14-B is a sectional view through the right portion 10-A of the Figure along the line K—K. The respective referentials which are known from the description of the earlier Figures are shown in the Figure to demonstrate their locations in a radial piston fluid handling device. The functions and configurations of the portions, parts and like are already known from the description in the earlier Figures.

The piston of FIG. 15 is similar to that of FIG. 11 and shown in the same scale and sections or views for a 42 cc motor with the one difference, that the piston of FIG. 11 has a part-cylindrical pivot-bed 4, while the piston of FIG. 15 has a part-part ball formed pivot-bed 104. Accordingly the piston shoe of FIG. 16, which can be assembled into or laid into piston of FIG. 15 has a part-ball-formed inner pivot-portion 120 instead of the part-cylidrically formed portion of FIG. 14. Important is, that the piston of FIG. 15 requires outcuts 91 and 92 in order to be able to extend through the slot of the "H-form" of the piston shoe and into the annular ring groove 34 of the actuator ring 35. The term "outcuts" defines recesses or depressions.

The piston shoe of FIG. 16, shown in sectional FIGS. 16-A and 16-B with FIG. 16-A taken along the arrowed line of FIG. 16-B, which can be laid or be assembled into the piston of FIG. 15, shows the outcuts, recesses or slots 93 and 94 which form the "H" of the entering or of the deep diving piston shoe of my earlier patents.

What matters in this present invention, is, that the radial extensions or portions 1,2 of the piston can extend through slots 93 and 94 of the piston shoe of FIG. 16 and pass with their outer ends 1,2 and 101,102 beyond the outer face 16 of the piston shoe of FIG. 16.

The bottom FIG. 15-D of FIG. 15 is a view from top upon the left portion of FIG. 15 in order to clearly make visible the narrower portions 101 and 102 in relation to the extensions 1,2 and in relation to the pivot bed 104 with face 6.

The spring plate of FIG. 17 is described already at the description of FIG. 13.

In FIG. 18 the piston and piston shoe of FIGS. 15 and 16 are assembled into a respective portion of a radial piston device. Again, this Figure is shown in a 1:1 scale for a 42 cc/revolution device with 7 pistons of 20 mm diameter each. The scale can be obtained from the reduced scale patent drawing by comparing the 22 mm and the 36 mm of FIG. 12.

In FIG. 19 three sections, namely Figure portions 19-A to 19-C show sections through the radial outer portion of another embodiment of the invention demonstrate a plurality of retaining pins assembled into the outer portion of the respective piston. Pins 96 extend into the extensions 1,2 and through the gap 5, whereby they retain the respective piston shoe in the gap 5 or in the pivot-bed 4. It can also be recognized from FIG. 19, that the outermost portion of the piston does not need a guide face on the cylinder wall and can be reduced in diameter, if so desired, in order to prevent friction or scratching of the ends of pins 96 on the cylinder's walls. That gives space for riveting of the pins 96 on the extensions 1,2 of the respective pistons. However, such riveting is not shown in the Figure, because it is not in all cases of practical application required.

FIG. 20 gives the actual data of tangential force, friction losses, pivot-angle "gamma," movements of pistons and pivotal movements in a schematic, but accurate, diagram for the values written in the Figure.

It may be appreciated, that these values show with overwhelming impression, how very big the losses due to friction in the pivot-faces and at the movement of the piston wall along the cylinder wall are and their reduction by this invention is.

Since according to this invention, the lateral friction losses between the piston and the cylinder wall can be reduced to a very small or neglectible remainder, it is sure, that the devices of this invention are technologically superior in efficiency, life time or power to devices of axial piston types with inclined plates as piston stroke guides. And, naturally also superior in power and efficiency to those newer designs which tried to copy or to improve my inventions of the early sixties and thereby brought products in the early seventies, which neg the fluid pressure pockets between the piston wall and the cylinder wall and which neglected the need for a long stroke at a given size of the piston stroke actuator by the application of the entering or of the deep diving piston shoe. And, which also neglected the requirement of a long piston guide as in my earlier patents and as specifically provided for by this present invention.

It should also be recognized, that the angle of inclination of pivotion and thereby the resulting lateral forces of the pistons are greater the deeper the pivot-center is located inside the piston. This is seen for example from FIGS. 3 and 9. The extensions of the invention make it possible to transfer the said pivot-center more radially outward, whereby the resulting lateral forces decrease in principle.

In FIG. 21 another embodiment of the invention is illustrated. FIGS. 1 to 20 correspond to the Figures and arrangements of the parental patent application and to the grand parental application, which is now patent 4,374,486. The embodiments of the mentioned patent have worked quite satisfactory at constant pressure and speed applications. At some industrial applications, such as for example, bite arms of power shovels which bite conrete with steel bars therein, a very high pressure is used for a short perid of time and then, when the steel is bitten through, very suddenly the pressure drops. That leads to sudden increase of the speed of the motor, since the engine still has full throttle power. As a result thereof, some of the motors of the grand parental patent broke. The reason of such breaking was not immediately found. The present invention, however, found the reasen for the sudden break of the mentioned several motors. The reasen is, that the arm of the power shovel swings at the moment of end of the bite of the steel bar nd thereby the motor also swings. It then happened, that the piston shoes lost their straight position and portions of the ends moved into spaces between the rotor and the actuator or piston stroke guide ring. At the further revolution of the motor the piston shoes then stuck between the rotor and the piston stroke guide ring and broke the motor.

It is therefore one aim and object of the invention, to overcome such sudden and undesired break of the motor. How to overcome this problem is shown in the embodiment of FIG. 21.

FIG. 21, thus, provides innermost radially plane face portion 214 and 215 on radially extended portions or walls 212 and 213. These walls may be integral with the rotor 24 or they may be fastened onto the rotor 24 or onto the stroke guide ring 35. The distance 222 in axial direction respective to rotor 24 forms a first distance 222. The piston shoes receive parallel axial ends to form parallel axial end faces 218 and 219 of a second distance 221. The second distance 221 is thereby the distance between the end faces 218 and 219 of the piston shoe 226. The second distance is slightly shorter than the first distance in order to permit the assembly of the piston shoes 226 between the innermost faces 214 and 215 of the walls 212 and 213. By forming this small difference between the first and second distance, the axial end faces 218 and 219 are guided on and between the innermost faces 214 and 215 which are at least partially radially plane respective to a plane which goes perpendicular and thereby normal through the axis of the rotor.

The axes 51 of the cylinders 26 and pistons 3 are thereby located in the mentioned perpendicular plane and they are thereby directed normal respective to the axis 225 of the rotor 24. The guiding of the axial ends of the piston shoes between the innermost faces of the mentioned walls or portions 212 and 213 prevents axial movement of the piston shoes and keeps the piston shoes closely guided between the innermost faces 214 and 215.

The radial medial plane of symmetry through the piston shoe is thereby also located in the mentioned perpendicular radial plane and the medial radial plane of symmetry of the piston shoe swings in the mentioned perpendicular radial plane. The guidance of the piston shoe between the innermost faces 214 and 215 substantially secures that the medial radial plane of symmetry of the piston shoe never departs axially too far from this position. This fact is very important in accordance with the present invention. Because it prevents the breaking of the motor which occurred in the mentioned power shovel.

The guidance of the end faces 218 and 219 of the piston shoe between the innermost faces 214 and 215 also prevents any blocking and destruction of the radial segments of the rotor and of the fingers of the pistons. Because it also helds the third and fourth distances 220 and 227 radially aligned above and below each other. The third distance is the distance 220 between the innermost faces of the walls of the annular groove 34 of the actuator or piston stroke guide ring 35. The fourth distance is the distance 228 of the axial ends of the rotor segments 229 and of the piston fingers 228 of FIG. 22. Segments 229 represent, for example, the rotor radial segments 124 of FIGS. 8 and/or 9. The piston fingers 228 represent, for example, the fingers or radial extensions 1 or 2 of FIG. 5. It is very important, that the arrangements of the mentioned grand parental patent become combined with the arrangement of the present invention of the now discussed Figures to prevent such accidents as have occurred. Because now, according to the present invention, the innermost faces 214 and 215 hold and direct the piston shoe, while the arrangement of, for example, FIG. 10, holds and directs the piston fingers relative to the piston shoe. That keeps the piston fingers 1,2,228 radially aligned with the annular groove of the piston stroke ring and any run or movement of the piston fingers by a pivotal movement of the piston around its axis 51 is prevented and it is secured that the piston fingers 1,2,228 at all times enter smoothly into the annular groove 34 of the stroke ring 35. For manufacturing the fourth distance 227 is shorter than the third distance 220. It is so much shorter that the tolerances of machining remain so, that the segments and fingers can enter the annular groove 34. However, the fourth distance should not be made so much shorter than the third distance, that the piston fingers and rotor segments would become axially too short to maintain the proper piston guide of the invention on the radial segments of the rotor. These matters will be best understood by comparing FIGS. 21 and 22 together.

FIG. 21 further shows the rotor passages 223 wherethrough the fluid flows into and out of the cylinders 26. This Figure further shows recesses 210 and 211 axially of the cylinders and these recesses extend radially inwardly into the rotor 24. The piston shoes have radial inwards extensions 216 and 217 on the axial ends of the piston shoes. These extensions are able to enter into the mentioned recesses 210 and 211.

To make the assembly and disassembly of the device comfortable it is preferred to provide the inner face of the stroke ring and thereby the piston stroke guide face of the actuator 35 with a first diameter 250. The outer diameters of the walls or portions 212 and/or 213 are then provided with a second diameter 251. The second diameter should be only slightly smaller than the first diameter in order that the stroke guide ring 35 can just be easily moved in axial direction over the walls or portions 212 and 213. When the pistons and piston shoes are assembled radially from the outside into the cylinders 26 and into the space between the innermost faces 214 and 215, the radial outer faces of the piston shoes 226 remain within the inner defines of the mentioned second diameter and thereby they do not extend radially beyond the outer diameter of the walls or portions 212 and 213. Thus, the piston stroke guide ring 35 can easily axially assemble over the piston shoes and walls; or, the entire rotor assembly with the pistons and piston shoes therein can easily be moved into piston stroke guide ring 35.

To obtain a perfect assembly, the piston shoe inward extensions 216 and 217 should be made long enough and the recesses 210 and 211 should be made deep enough to permit a size of length of 2 times of the eccentricuty "e" between the rotor axis 225 and the eccentric axis 224 of the stroke ring 35 for the axial endfaces 218 and 219 and also for the innermost faces 214 and 215. Thus, the end faces and the innermost faces, namely 218,219, 14 and 215 should be at least as long as the piston stroke is or better be slightly longer. Since the piston stroke is two times of the mentioned eccentricity "e", the mentioned end faces and innermost faces should be radially at least two times longer than the distance between the concentric and eccentric axes 224 and 225.

Thus, the invention provides the following arrangement:

In a radial piston device wherein fluid flows from inlet means through passages into and through substantially radially arranged cylinders of a rotor revolvably mounted in a housing of said device and discharges out from said cylinders through passages and outlet means, the combination of pistons reciprocating in said cylinders, piston shoes interposed between the piston stroke guide face(s) of a piston stroke guide means and said pistons, a piston shoe bearing bed for each individual piston shoe in the respective piston wherein a portion of the respective piston shoe is pivotable around a pivot center and thereby around a pivot axis which is parallel to the axis of said rotor;

an "H-form" of each individual piston shoe when seen from top having slots between the lateral guide portions of said H-formed piston shoe laterally of medial radially extended segments of said rotor;

each individual cylinder of said cylinders provided with wall portions which extend along said segments of said rotor with radii equal to the radii of said cylinders and with the roots of said radii located individually along the radially extended axes of said pistons;

axial ends of said piston shoes provided on each individual piston shoe of said piston shoes along the respective lateral outer ends of said guide portions of said piston shoes; and an improvement; wherein said improvement provides, in combination, (a) radially extended innermost face portions distanced from each other by a first distance and provided to respective portions of said rotor;

(b) parallel axial end faces provided on the lateral ends of said piston shoes to form on said axial ends of said piston shoes parallel guide faces of a second distance;

(c) said second distance slightly shorter than said first distance to permit the setting of said piston shoes between said innermost face portions;

(d) guidance of said parallel end faces of said piston shoes on said innermost faces to prevent lateral movements of said piston shoes and to keep said pivot axes parallel to said axis of said rotor;

(e) location of the longitudinal axes of said pistons in a radial plane which is perpendicular and thereby normally directed relative to said axis of said rotor;

(f) radial extensions of portions of said pistons, individually substantially symmetric about said radial plane and said longitudinal axes of said pistons;

(g) direction of said extensions of said pistons towards said piston shoes; extended beyond said pivot centers; and;

(h) retaining means to prevent excape of said piston shoes from said pistons.

FIGS. 23 to 27 illustrate a piston-piston shoe assembly to a rotor which combines a large area of the outer face of the piston shoe with an increased length of the piston stroke relative to the common radial piston devices. To obtain a high pressure in the device, the outer face of the piston shoe 230 has no slots and no "H"-form. Thereby the entire outer face 249 can be utilized to carry the radial load of the pistons at the power strokes. So far the arrangement is as in common radial piston devices.

Since such devices, however, have only short piston strokes, it is desired to increase the length o the piston stroke in accordance with this embodiment of the invention. Thereby the efficiency and power of the device will also be increased.

To obtain this aim and object of the invention, the rotor is provided with radially extending portions 247 and 248. These are no full radial segments as on the rotors for the mentioned deep diving piston shoes, but only radially extending portions. They would just be portions of the radial segments 124 of FIGS. 8 and 9. The piston shoe 230 is now, according to the invention, provided with first recesses 245 and 246 which extend radially from the inside into the piston shoe and which are so dimensioned, that the mentioned rotor portions 247 and 248 can enter into the first recesses 245 and 246. Thereby the stroke of the pistons is elongated as it is desired with the present object of the invention. It is however required, to provide also second recesses 243 and 244 in order to make it possible that the piston fingers 1,2,238 can also enter into the piston shoe. Because otherwise the piston fingers would prevent the longer piston stroke because they would run against the bottom portion of the piston shoe 230. Thus, the second recesses 243 and 244 are also provided from radially inwards into the piston shoes 230. These second recesses are commonly directed under about fifteen degrees as shown in FIG. 24 to permit the swing or pivotion of the piston shoe relative to the piston. The arrowed line XXVII in FIG. 24 is shown in the mentioned about fifteen degrees direction. The second recesses 243 and 244 can under these circumstances be easily machined by end mill cutters on common milling machine tools. FIG. 27 shows these second recesses in the piston shoe in the sectional view along the arrowed line XXVII—XXVII of FIG. 24.

The piston shoe may be k pt in the piston by a pin 235 of FIG. 23. This pin is 180 degrees turned relative to the pin of FIG. 36. The piston 236 is for the insertion of the mentioned pin provided with recesses 233,234. FIGS. 25 and 26 show the piston in a separated illustration. FIG. 27 shows a portion of the piston shoe in a separated illustration.

From a comparison of these Figures with the earlier Figures follows, that the piston of the now discussed embodiment has shorter fingers or radial extensions than the pistons of the arlier Figures have. Thus, the piston of FIGS. 24 to 26 has short radial extensions 238, which extend beyond the top face 237 of the piston 236. These are the radial extensions of the piston the piston arms or piston fingers which enter during operation of the device into the second recesses 243 and 244 of the piston shoes of this embodiment of the invention.

The piston shoes may be provided again with the axial end faces of FIG. 21 to guide the piston shoes on respective innermost faces, for example, as on innermost faces 214 and 215 of FIG. 21. These end faces 218 and 219 are parallel relative to each other and they are also shown in FIG. 16-A. Thus, the end faces 218,219 are parallel to each other and the radial plane of medial symmetry of the piston shoe is also parallel to the axial end faces 218,219 and located in the middle between them. The distances of the medial plane of symmetry are thereby the half of the mentioned second distance 221.

The FIGS. 23 to 27 illustrate, for example also the following embodiment of the invention:

In a radial piston device wherein fluid flows from inlet means through passages into and through substantially radially arranged cylinders of a rotor revolvably mounted in a housing of said device and discharges out from said cylinders through passages and outlet means, the combination of pistons reciprocating in said cylinders, piston shoes interposed between the piston stroke guide face(s) of a piston stroke guide means and said pistons, a piston shoe bearing bed for each individual piston shoe in the respective piston wherein a portion of the respective piston shoe is pivotable around a pivot center and thereby around a pivot axis which is parallel to the axis of said rotor;

each individual cylinder of said cylinders provided with wall portions which extend along radial extensions of said rotor with radii equal to the radii of said cylinders and with the roots of said radii located individually along the radially extended axes of said pistons;

axial ends of said piston shoes provided on each individual piston shoe of said piston shoes along the respective lateral outer ends of said guide portions of said piston shoes; and an improvement; wherein said improvement provides, in combination, (a) radially extended innermmost face portions distanced from each other by a first distance and provided to respective portions of said rotor;

(b) parallel axial end faces provided on the lateral ends of said piston shoes to form on said axial ends of said piston shoes parallel guide faces of a second distance;

(c) said second distance slightly shorter than said first distance to permit the setting of said piston shoes between said innermost face portions;

(d) guidance of said parallel end faces of said piston shoes on said innermost faces to prevent lateral movements of said piston shoes and to keep said pivot axes parallel to said axis of said rotor;

(e) location of the longitudinal axes of said pistons in a radial plane which is perpendicular and thereby normally directed relative to said axis of said rotor;

(f) radial extensions of portions of said pistons, individually substantially symmetric about said radial plane and said longitudinal axes of said pistons;

(g) direction of said extensions of said pistons towards said piston shoes; extended beyond said pivot centers; and;

(h) retaining means to prevent escape of said piston shoes from said pistons.

Figure 29:
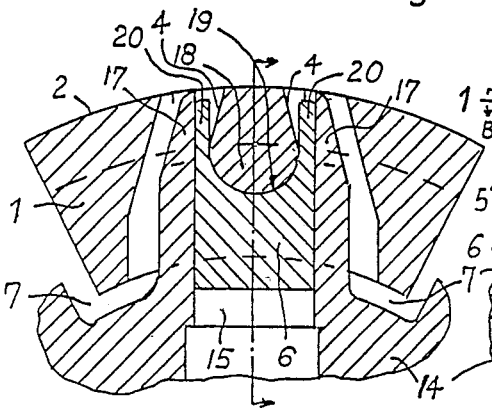
FIG. 29 is a cross-sectional view through FIG. 28 along the line A—A therein.
Figure 28:
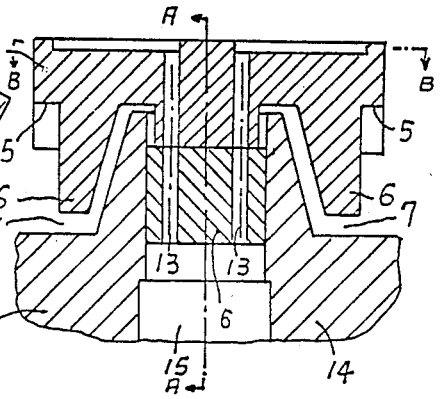
FIG. 28 is a longitudinal sectional view through a portion of another embodiment of the invention.
Figure 30:
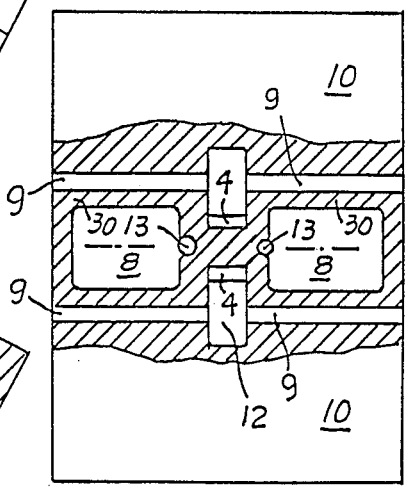
FIG. 30 is a cross-sectional view through FIG. 29 along the line B—B therein.

FIG. 28 with the thereto belonging cross-sectional FIGS. 29 and 30 show a piston shoe for very high pressure. Occasionally very high pressures are required especially in hydraulic liquid, for example in oil or water. When the pressure reaches rates of ten thousand or more psi the material of the piston shoes may tire out by the high frequencies of the periodic variances of the pressure. At high RPM such tiring may also appear already at the five thousand psi pressure ranges. That may lead to deformations of the piston shoe's outer face. In other applications of the piston shoe a large area may be required as outer face, for example, when the outer face shall run along a non-rotary piston stroke guide face. The bearing face will then carry only a limited load per size of area. But the centrifugal forces at high RPM may be very high. The embodiment of the invention of these figures, therefore, applies radial strengtheners 6 to the piston shoe and these may include axial elongations. Thereby the shoe shall overcome the described difficulties of the piston shoes of the former art.

The piston shoe-piston- and rotor-arrangement of FIGS. 28 to 32, therefore, demonstrates the following novel arrangement of the invention:

Piston shoe 1 has a medial pivot portion 18 with a pivot face 3. With it the piston shoe 1 is pivotably borne in bed 19 of piston 6 between the piston's radially extending fingers 20. The medial portion of the piston shoe is provided with a recess 12 which extends radially entirely through the piston-shoe's medial portion. The medial portion of the piston shoe is also provided with inclined faces 4 which permit the pivotion of the medial piston shoe portion between the fingers 20 of the piston 6. Without the inclination of the faces 4 the piston shoe could not pivot in the piston. The inclined faces 4, therefore, prevent touching of the medial shoe portion with finges 20 of the piston shoe 1. The rotor 14 has the substantially radial cylinders 15, wherein the pistons 6 are reciprocating. Radially of the cylinders and tangentially or peripherially extending from them are the radial extensions 17 of the rotor provided. They are however so short in the tangential or peripherial direction of the cylinder or rotor, that they are able to enter into the recess 12 of the piston shoe. The recess 12 of piston shoe 1 is, therefore, provided in order to receive during operation of the device with rotation of rotor 14 at least temporarily the piston's fingers 20 and the radial extensions 17 of rotor 14, at least partially. By this arrangement a relatively large piston stroke and thereby big power is obtained at a given radial outer size of the device. Rotor 14 has also outformed spaces 7 which are suitably located and configurated to receive at least temporarily the radial strengtheners 6 of the piston shoe 1. Thereby the radial strengtheners 6 can at least partially and at least temporarily be received in the outlined spaces 7 of rotor 14, when the device operates with a revolving rotor 14.

Figure 31:
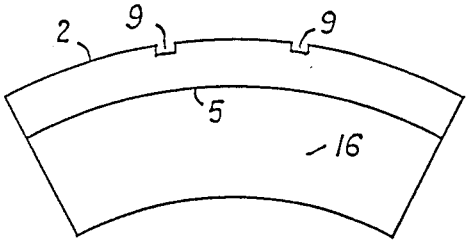
FIG. 31 shows the shoe of FIG. 29 in a separated illustration.
Figure 32:
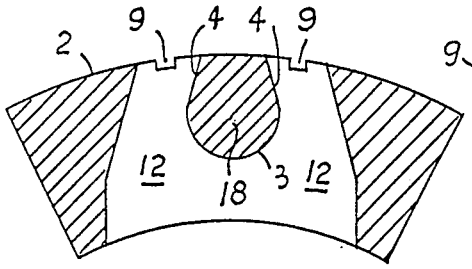
FIG. 32 is a longitudinal sectional view through still a further embodiment of the invention.

This arrangement of the invention makes it possible for a device with a relatively large piston stroke and a big power at high pressure in fluid, to extend the radial strengtheners 6 of the invention in such a size, that the desired high pressure and power can be obtained, by respective radial and/or axial extension of the strengtheners 6 of the invention. Radial passages 13 may be provided to extend through the piston 16 and through the piston shoe 1 to port into at least 1 or more fluid pressure balancing pocket(s) 8 in the outer face 2 of the piston shoe 1. Unloading recesses 9 are commonly provided to restrict the size of the sealing land(s) 30 which surround and seal the respective fluid pressure pocket(s) 8. Thereby the "unsecure areas" which might or would lead to welding are prevented. Endwards, seen in the direction of movement of outer face 2 and in the thereto opposite direction are then the very big sizeable bearing face portions 10 of the slide face or outer face 2 of the piston shoe 1. These are now capable of either providing support face sections with respective unloading recesses between them which lubricate without hydrodynamic pressure fields, or alternatively to serve as hydrodynamic bearing faces, when they are respectively formed and relatively slightly inclined. The piston shoe 1 may also be provided with traction faces 5 for the drawing of the piston shoe and the associated piston in the radial outwards stroke, when faces 5 are guided by a respective traction member. For a good understanding of the embodiment of the invention, FIG. 28 is a sectional view taken along the arrowed line of FIG. 29, whereby FIG. 29 is also a section along the arrowed line A—A of FIG. 28. FIG. 30 partially shows the outer face or portion of piston shoe 1 along the arrowed line B—B of FIG. 28 and partially from top of FIG. 28. FIGS. 31 and 32 show the piston shoe of the invention in separated demonstrations for a better view onto the decisive configurations. FIG. 32 is therefore a cross-sectional view through FIG. 28 along line A—A, however, exclusively through the piston shoe 1. FIG. 31 shows the separated piston shoe 1 as seen from an axial end thereof.

Figure 34:
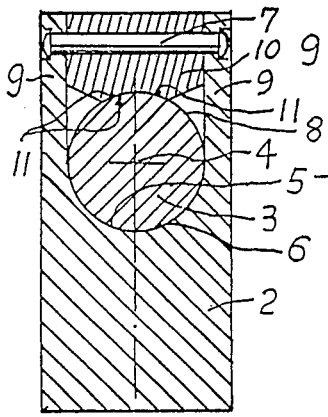
FIG. 34 shows an alternative assembly portion in FIG. 33.
Figure 33:
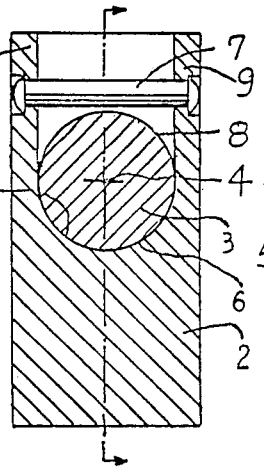
FIG. 33 is a cross-sectional view through FIG. 32 along the arrowed line.
Figure 32:
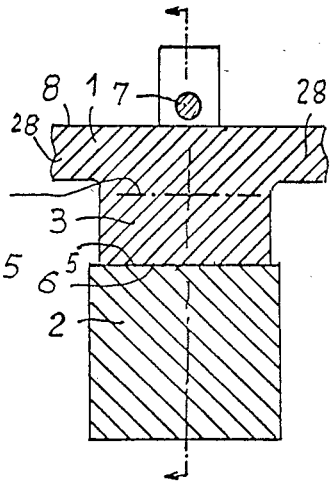

FIGS. 32 to 34 demonstrate an improvement of the holding arrangement for a piston shoe in a piston. Piston 2 has bearing bed 5 to pivotably bear thereon the pivot portion 3 of piston shoe 1. During pivotion of piston shoe 1 in piston 2 the pivot face 6 of pivot portion 3 of the piston shoe slides along the pivot bed or bed face 5 of the piston. The piston fingers 9 are extending radially from the main body of piston 2 and from bearing bed 5 or from portions thereof. The fingers 9 extend radially beyond the outer face 8 of piston shoe 1. The medial portion 3 of the piston shoe 1, which may have axial extensions 28, is formed in this figure as a cylindrical bar. According to this embodiment of the invention, a holding pin 7 is inserted into the fingers 9 of piston 2 at such a location, that the outer face portion of bar 7 meets the respective outer face portion of medial portion 3 of piston shoe 1. A radial escape of the piston shoe 1 from the piston 2 is thereby prevented. The specific feature of this embodiment of the invention is that also an escape of pivot face 6 from bed 5 is prevented and no gap can appear between faces 5 and 6. Another feature of this embodiment of the invention is, that the main feature of prevention of a gap between faces 5 and 6 is obtained with little cost and time at manufacturing and can be obtained easily and comfortably.

In FIG. 34 a holding body 10 is inserted between the fingers 7 of the piston and kept there by holding pin 7. Holding body 10 is provided according to the invention with a complementary holding face portion 11 to fit along and hold the outer face portion 8 of the medial portion 3 of piston shoe 1. The face 11 is, therefore, complementary configurated relative to the configuration of the face 8 of the medial piston shoe portion 3. FIGS. 33 and 34 are sectional views along the respective arrowed line of the other of the Figures.

Figure 36:
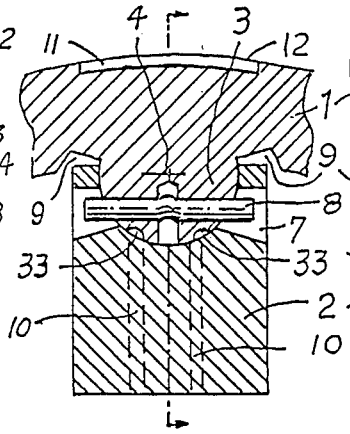
FIG. 36 is a cross-sectional view through FIG. 35 along the arrowed line.
Figure 35:
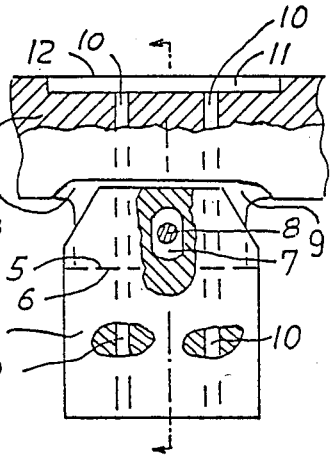
FIG. 35 shows a piston-piston shoe assembly of the invention partially in section and partially in a view onto it.

FIGS. 35, 36 demonstrate a still further embodiment of a piston-shoe arrangement to a piston. Medial piston shoe portion pivots around pivot cent 4 as in FIG. 32. A pin 8 is inserted perpendicularly through the medial portion 3 and extended into slots 7 which are provided through the respective portions of piston 2. Since slots 7 extend only radially through piston 2, the piston shoe is prevented by pins 8 in medial portion 3 and in slots 7 from escape from piston 2. In order to maintain a long piston guide, recesses 9 may be cut into the piston shoe portion to permit a good pivotion of shoe 1 in piston 2. Fluid pressure passages 10 may be provided to end in pocket(s) 11 of outer face 12. An escape of the piston shoe from the piston is thereby prevented, while a long piston guide is maintained even at an extensive pivotion of piston shoe 1 in piston 2. If recesses 9 are not provided in the piston shoe, the arrangement can be used for devices with limited piston strokes only, because the piston could then not be as highly radially extended as seen in FIGS. 35, 36. The then radially shorter outer portion of piston 2 would at larger piston strokes then lead to welding of the piston on the respective wall of the cylinder wherein the piston reciprocates. Because the guide face relationship between cylinder wall and piston outer face would be too short. This shows how important the provision of recesses 9 is. There are, however, limitations to the extension of recesses 9, because if they would be made too wide, the strength of the piston shoe 1 would suffer.

Figure 37:
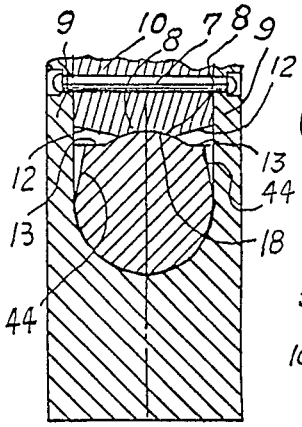
FIG. 37 shows a further alternative assembly to FIG. 33.

In FIG. 37 the pin 8 and recesses 7 of FIG. 32 are replaced by a holding body 10 which is kept by a holding pin 7 in radially extending piston fingers 9. The fingers 9 are radially extended beyond the outer face 12 of the piston shoe to provide holding portions for the holding pin 7 and holding body 10. In order to obtain a suitable holding of the piston shoe in the piston while permitting a good ability of pivotion of piston shoe 1 in piston 2, the medial portion 3 of piston shoe 1 is provided with a part-cylindrical outer face 8 to lay on and slide on a thereto complementary holding face 18 which is provided on holding body 10. The part-cylindrical outer face 8 of the medial portion 3 is ended by face-portions 13 to prevent a too large softening of the strength of piston shoe 1. Inclined faces 44 of the medial portion 3 of piston shoe 1 serve as the inclined faces 4 of FIGS. 28 to 32. As far as referential numbers are not specifically mentioned, the thereby defined parts are acting similarly to those of other Figures, of FIGS. 28 to 37.

The recesses 7 of piston 2 of FIG. 36 may also act as tangential fluid pressure pockets between the outer face of the piston 2 and the respective wall of the cylinder along which the piston slides. In such case, control recesses 33 may be provided in the medial portion 3 of piston shoe 1 to control the periodic communication and discommunication of pocket-recesses 7 to and from the passage(s) 10 of piston 2.

What is claimed, is:

1. In a radial piston type device, wherein fluid flows through substantially radially arranged cylinders, the combination of pistons which reciprocate in said cylinders, piston shoes interposed between a piston stroke actuator guide means and said pistons with said piston shoes pivotably borne on bearing beds in said pistons; each individual piston of said pistons bearing one piston shoe of said piston shoes, each individual shoe of said shoes forming an "H-form" when seen from above with said "H-form" provided by the slide portion of said shoe with said slide portion sliding with its slide face along the piston stroke guide face of said actuator means, said slide portion provided above the pivot portion of said shoe below said slide portion of said shoe, said pivote portion borne in said bearing bed of the respective individual piston of said pistons, said "H-form" further defined by slots which extend radially fully through said slide portion and from the medial portion above said pivot portion between axial end portions of said slide portions in forward and rearward directions respectively and relative to the direction of movement of said shoe along said piston stroke guide face, holding means engaging said piston and shoe to prevent escape of said shoe from said piston, and an improvement, wherein said improvement consists in the provision of two radial extensions on each individual piston of said pistons with said extensions extending radially outwardly from the radial outer end of the body of said piston with said extensions diametrically oppositely located relative to the axis of said piston, wherein said extensions extend from said bearing bed of said individual piston in radial outward direction towards said slots in said individual shoe of said shoes and radially beyond the pivot center of said shoe in said piston into said slots of said shoe, wherein said holding means include pins which are fastened in said piston while two diametrically opposed located recesses are provided in said pivot portion and said medial portion of said individual shoe with said recesses forming holding walls radially below said pins and below said pivot center, and, wherein said pins extend individually into the respective recess of said recesses while said holding walls are slightly distanced from said pins to permit a pivotal movement of said shoe in said piston and of said pins in said recesses.

* * * * *